US010378114B2

(12) United States Patent
Zhu et al.

(10) Patent No.: US 10,378,114 B2
(45) Date of Patent: Aug. 13, 2019

(54) CATHODE PROTECTION METHOD AND APPARATUS FOR REINFORCED CONCRETE STRUCTURE AND COMPOSITE STRUCTURE AND PROCESSING METHOD FOR REINFORCED CONCRETE STRUCTURE

(71) Applicant: SHENZHEN UNIVERSITY, Shenzhen, Guangdong (CN)

(72) Inventors: Jihua Zhu, Shenzhen (CN); Feng Xing, Shenzhen (CN); Ningxu Han, Shenzhen (CN); Wei Liu, Shenzhen (CN); Weilun Wang, Shenzhen (CN); Miaochang Zhu, Shenzhen (CN)

(73) Assignee: SHENZHEN UNIVERSITY, Shenzhen, Guangdong (CN)

( * ) Notice: Subject to any disclaimer, the term of this patent is extended or adjusted under 35 U.S.C. 154(b) by 154 days.

(21) Appl. No.: 15/358,064

(22) Filed: Nov. 21, 2016

(65) Prior Publication Data

US 2017/0121827 A1 May 4, 2017

Related U.S. Application Data

(63) Continuation of application No. 14/253,835, filed on Apr. 15, 2014.

(51) Int. Cl.

| | |
|---|---|
| ***C23F 13/02*** | (2006.01) |
| ***C23F 13/16*** | (2006.01) |
| ***C23F 13/06*** | (2006.01) |

(52) U.S. Cl.

CPC ..... *C23F 13/16* (2013.01); *C23F 13/06* (2013.01); *C23F 2201/02* (2013.01); *C23F 2213/22* (2013.01)

(58) Field of Classification Search

CPC ..... C23F 13/02; C23F 13/06; C23F 13/08; C23F 13/10; C23F 13/12; C23F 13/16; (Continued)

(56) References Cited

U.S. PATENT DOCUMENTS

2009/0229994 A1* 9/2009 Davison et al. ..... C23F 13/02 205/734

FOREIGN PATENT DOCUMENTS

EP 0147977 A2 * 7/1985 ..... C23F 13/02
EP 1318247 A1 * 7/2001 ..... C23F 13/02

OTHER PUBLICATIONS

Kosmatka et al ("Design and Control of Concrete Mixtures", Portland Cement Association, pp. 210-213, 2008) (Year: 2008).*

(Continued)

*Primary Examiner* — Alexander W Keeling
(74) *Attorney, Agent, or Firm* — Raymond Y. Chan; David and Raymond Patent Firm

(57) ABSTRACT

A cathode protection method of embedded CFRP anode for reinforced concrete structure includes the following steps. Provide a preformed groove with a predetermined shape and size in a surface of a protection area of a reinforced concrete body, and remove dust in the preformed groove. Provide a CFRP member on the surface of the protection area of the reinforced concrete body. Coat an electrical conductive adhesive material between side surfaces of the reinforcing column of the CFRP member and the preformed groove and between the reinforcing plate and the reinforced concrete body. Connect the CFRP member with a positive electrode of an external DC power supply and the steel reinforcing element with a negative electrode of the external DC power supply.

12 Claims, 3 Drawing Sheets

(58) Field of Classification Search
CPC ... C23F 13/18; C23F 2201/02; C23F 2213/22
See application file for complete search history.

(56) References Cited

OTHER PUBLICATIONS

Mapei ("Galvanic Cathodic Protection", pp. 26-27, 2010) (Year: 2010).*
Chrysler Group LLC ("Corrosion Repair", 2012) (Year: 2012).*
Machine Translation of EP1318247A1.*

* cited by examiner

CATHODE PROTECTION METHOD AND APPARATUS FOR REINFORCED CONCRETE STRUCTURE AND COMPOSITE STRUCTURE AND PROCESSING METHOD FOR REINFORCED CONCRETE STRUCTURE

CROSS REFERENCE OF RELATED APPLICATION

This is a Continuation application that claims priority to U.S. non-provisional application, application Ser. No. 14/253,835, filed Apr. 15, 2014, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a field of building materials, and more particularly to a cathode protection method of embedded CFRP anode for a reinforced concrete structure. And, the present invention further relates to a composite structure and a processing method for reinforced concrete structure with a cathode protection CFRP structure.

Description of Related Arts

The main reason for the eroding durability of the deterioration of the reinforced concrete structure is the internal corrosion of the steel reinforcing element. Currently, the impressed current cathode protection technology has proven to be one of the most effective methods to inhibit the corrosion of the steel reinforcing element. The impressed current cathode protection technology is based on the principle of the PH-potential diagram, wherein cathode current is applied to the steel reinforcing element for forcing the potential of the steel reinforcing element in the corrosion-free area so as to reach the protection purpose for the steel reinforcing element.

Accordingly, an auxiliary anode is one of the most important parts in the impressed current cathode protection technology. One of the existing auxiliary anode structures is that the auxiliary anode is tiled in pieces on a surface of the structure of the steel reinforcing element, and the other auxiliary anode structure is that the auxiliary anode is spacedly affixed into a pre-designed preformed grooves, wherein these two structures of the existing auxiliary anode are related to the structure of the protection area and the resistance of the concrete. The auxiliary anode of the first auxiliary anode structure is widely coved on the surface of the structure of the steel reinforcing element, wherein the auxiliary anode has the larger coverage area so as to facilitate the distribution of the current, but it is also limited by the effects of the non-uniform resistance of concrete, such as a mixed metal titanium oxide anode. The auxiliary anode of the second auxiliary anode structure as mentioned above is that the auxiliary anode is spacedly affixed in the preformed grooves of the structure of the steel reinforcing element, wherein the coverage area of the auxiliary anode is relative small which means the distribution of the current is relatively weak, but this manner reduces the distance between the steel reinforcing element and the concrete so as to reduce the resistance therebetween, such as the buried-type anode. Furthermore, the concrete is a heterogeneous material, and has great resistance and uneven in distribution, such that the concrete is easy to be affected by the environmental factors.

In the present technology, according to the perspective of the material science, the use of a steel, fiber-reinforced polymer (referred to as FRP) or carbon fiber reinforced polymer (CFRP) are utilized to process structural steel reinforcing element and bonding materials. However, the construction process has several defects and errors; any deterioration during the construction process will destroy this protective layer (structural strengthening materials) so as to cause the secondary corrosion of the concrete.

In recent years, FRP-concrete composite structures are increasingly attracted by the attention of scholars. This is because FRP-concrete composite structure can improve the force situation, wherein the FRP are templates in the construction process, so no additional templates and no corresponding template removal steps are needed, such that the FRP has an excellent durability. A Good durability of the FRP-concrete composite structure is mainly due to the use of good durability of the FRP, and the FRP has the ability to prevent intrusion of external harmful substances in a member while FRP is overall wrapped on that member. The structural durability is more sensitive to the required of the materials, the construction process and the working environment. When an improper construction step happened, the durability of the FRP-concrete composite structure will no longer have the advantages due to the internal defects of the FRP materials and plenty of harmful substances which contain therein. While using concrete with rich of chlorides, sulfates and other harmful substances, such as sand type concrete, the concrete has various conditions of the acceleration of the corrosion of steel reinforcing element, so the corrosion of the steel reinforcing element within the FRP-concrete composite structure occurs more earlier, wherein the durability of the FRP-concrete composite structure is damaged, so the FRP-concrete composite structure need to be repaired and maintained early.

The most common structural strengthening materials in the structural strengthening field and the composite structure field are carbon fiber reinforced polymer (CFRP), which has the advantages of light in weight, high in strength, high in modulus, and having good corrosion resistance, so CFRP is a well-known structural strengthening material. Including the well-known dynamic properties of CFRP, its essential element, carbon fibers, has good electrochemical properties, which has good electrical conductivity and the electrode potential is close to the electrochemical property of the noble metal. Therefore, the electrochemical properties of the CFRP can be applied to the auxiliary anode of the impressed current cathode protection system for the reinforced concrete structures. And, the electrochemical properties and the dynamic properties of the CFRP also can be applied to form a new type composite structure for reinforced concrete structure with a good durability.

Furthermore, the electrochemical properties and the dynamic properties of the CFRP also can be applied to form a new type composite structure for reinforced concrete structure having steel reinforcing element protection and cathode protection. The CFRP, as a composite material in the structure, not only has advantages in the composite structure, but also is an auxiliary anode in the impressed current cathode protection system. The weak cathode current is applied to the CFRP-composite structure while the structure starts to be built, and the steel reinforcing element in the CFRP-composite structure is in a cathode polarization situation for a long time, so as to achieve the protection effect. Therefore, the CFRP-composite structure has a strong ability to resist the corrosion of the steel reinforcing element due to the inherent or the external intrusion of chlorides ions, or the intrusion of other corrosive media, so as to significantly improve the durability of the CFRP-composite structure.

In addition, the entire impressed current cathode protection system for the reinforced concrete structure comprises pre-protected steel reinforcing elements, an auxiliary anode, a DC power detection system and a control system. Within, the major costs of the impressed current cathode protection system are based on the auxiliary anode and the control system, so in order to control the cost of cathode protection system, it is important to develop an optimum auxiliary anode or an improved configuration of the control system. Within, the optimum auxiliary anode is able to achieve by researching the auxiliary anode having a main component of CFRP.

After applying impressed cathode current to the steel reinforcing element, it is needed for testing the corrosion condition of the steel reinforcing element, and measuring electrochemical parameters thereof, such as potential polarization, and the current density of the corrosion, and finally generating feedbacks to the control systems. When the electrochemical parameters of the corrosion condition of the steel reinforcing element does not match the requirements, the control system will regulate the voltage of the DC power supply or the current output thereof, so as to ensure an adequate protection for the steel reinforcing element. Therefore, the traditional impressed current cathode protection system requires expensive in routine maintenance and operation costs.

Therefore, the present invention of the impressed current cathode protection technology needs to be improved.

SUMMARY OF THE PRESENT INVENTION

A main object of the present invention is to provide a cathode protection method of embedded CFRP anode for a reinforced concrete structure and apparatus therefor, wherein the present invention is provided to solve the high costs of the cathode protection system while processing the impressed current cathode protection method for the reinforced concrete structure, such that the present invention also provides a best performance for protecting the reinforced concrete structure and reducing the maintenance costs.

Another object of the present invention is to provide a composite structure and a processing method for reinforced concrete structure with automatic cathode protection CFRP structure, wherein the CFRP has dual-functions as a composite-structure material and an auxiliary anode, wherein no investigation device and control systems are in the above mentioned apparatus, wherein the present invention is provided to solve the problems of high costs of the protection of the intrusion of inherent or external corrective media in the reinforced concrete structure, so no traditional investigation and control devices the composite structure and method for reinforced concrete structure with automatic cathode protection CFRP structure need to installed on the above described structure, so as to simplify the configuration of the present invention.

A cathode protection method of embedded CFRP anode for a reinforced concrete structure comprises steps of:

A. providing a preformed groove based on a predetermined shape and size in a protection area of a reinforced concrete body, and removing ail the dust within the preformed groove;

B. providing a CFRP member on a surface of the protection area of the reinforced concrete body, wherein the CFRP member includes a reinforcing column matching with the preformed groove and a set of reinforcing plate affixed on inner surfaces of the protection area of the reinforced concrete body;

C. coating adhesive material with conductive function on the reinforcing column of the CFRP sheet, two side surfaces of the preformed groove, and a surface between the concrete and the reinforcing plate, so the reinforcing column is affixed within the preformed groove and the reinforcing plate is affixed on the concrete; and D. connecting the CFRP member with the positive electrode of the external power supply, and connecting the steel reinforcing element with the negative electrode of the external power supply, so the steel reinforcing element and the adhesive material are electrically connected together via the concrete to form a serially-closed current loop.

Before the step A, the cathode protection method of embedded CFRP anode for a reinforced concrete structure further comprises a step AO of removing loose concrete within the protection area of the reinforced concrete body, and polishing and smoothing the remaining concrete within the protection area is provided.

Between the step B and step C, the cathode protection method of embedded CFRP anode for a reinforced concrete structure further comprises a step B1 of filling adhesive material into the uneven area and pressing thereon so as to remove the air within the adhesive material is provided.

The step C of the cathode protection method of embedded CFRP anode for a reinforced concrete structure further comprises a step C1 of testing the electric connectivity between each of the steel reinforcing elements is provided.

Between the step C and step D, the cathode protection method of embedded CFRP anode for a reinforced concrete structure further comprises a step DO of checking the electric connectivity between the steel reinforcing element, the concrete, and the CFRP member is provided.

Adhesive material of the cathode protection method of embedded CFRP anode for a reinforced concrete structure are cement grout or epoxy flues with conductive particles.

The present invention provides a cathode protection apparatus for embedded CFRP anode for reinforced concrete structure, which comprises:

a reinforced concrete body comprising one or more steel reinforcing elements embedded therein and having at least a preformed groove therein and defining adjacent side surfaces thereon adjacent to the preformed groove;

at least a CFRP member comprising a reinforcing column and a reinforcing plate integrally connected with the reinforcing column, wherein the reinforcing column is shaped and sized with respect to the preformed groove and inserted into the preformed groove while the reinforcing plate facing the side surfaces;

an electrical conductive adhesive material applied between the reinforcing column and side surfaces of preformed groove and between the adjacent side surfaces of reinforced concrete body and the reinforcing plate; and a direct current (DC) power supply which has a positive electrode connecting with the CFRP member and a negative electrode connecting with the steel reinforcing elements in the reinforced concrete body in such a manner that the steel reinforcing elements, the adhesive material, the concrete, and the CFRP member form a close electrical conductive circuit.

According to the cathode protection apparatus of embedded CFRP anode for reinforced concrete structure of the present invention, the CFRP member is a CFRP plate.

According to the cathode protection apparatus for embedded CFRP anode for reinforced concrete structure of the present invention, all the steel reinforcing elements within the protection area are electrically connected with each other. According to the cathode protection apparatus of embedded CFRP anode for reinforced concrete structure of the present invention, the adhesive material are cement grout or epoxy flues with conductive particles.

The present invention provides a cathode protection method of embedded CFRP anode for reinforced concrete structure and apparatus thereof, wherein the CFRP member is used as an auxiliary anode so as to not only provide a best protection performance, but also reduce the protection costs compared with the existing mixed metal titanium oxide anode, and that the embedding connection between the reinforcing column of the CFRP member and the corresponding preformed groove of the reinforced concrete structure beneficially reduces the resistance of the concrete within the protection area so as to achieve an even distribution of the protective current.

A processing method for reinforced concrete structure with automatic cathode protection CFRP structure comprises steps of:

a. integrally mounting reinforced concrete body with a CFRP member:

b. mounting the CFRP member on a surface of a reinforcing region of the reinforced concrete body;

c. embedding at least one steel reinforcing elements around an inner peripheral of the reinforced concrete body; and d. connecting an external power supply to the CFRP member for impressing current to the steel reinforcing elements.

In the processing method for reinforced concrete structure with automatic cathode protection CFRP structure, the CFRP member is a composite material, which mixes with different fibers or matrix materials.

A composite structure for reinforced concrete structure with automatic cathode protection CFRP structure comprises:

a CFRP member arranged on a surface of a reinforcing region of a reinforced concrete body;

at least one steel reinforcing elements embedded into the reinforced concrete body; and an external power supply connected to the CFRP member for impressing current to the steel reinforcing elements; wherein the reinforced concrete body is integrally mounting with a CFRP member.

In the composite structure for reinforced concrete structure with automatic cathode protection CFRP structure, the reinforced concrete body comprises a plurality of steel reinforcing elements, and each of the steel reinforcing elements is electrically connected.

In the composite structure for reinforced concrete structure with automatic cathode protection CFRP structure, the external power supply is a DC power supply.

In the composite structure for reinforced concrete structure with automatic cathode protection CFRP structure, the reinforced concrete body are circular concrete column, wherein a plurality of steel reinforcing elements are arranged around an inner peripheral of the reinforced concrete body, and the adjacent steel reinforcing elements are electrically connected.

In the composite structure for reinforced concrete structure with automatic cathode protection CFRP structure, the CFRP member is a CFRP pipe.

The present invention provides a composite structure and method for reinforced concrete structure with automatic cathode protection CFRP structure, wherein the present invention provides a cathode protection, and the steel reinforcing elements within the concrete are impressed by a weak current via the CFRP materials so as to achieve the protection purposes, so the corrosion of the steel reinforcing elements within the sand type concrete has been prevented. And, the CFRP has dual-functions of the structural reinforcement and the cathode protection. While present invention is applied to the reinforced concrete structure, the steel reinforcing elements can be well-protected under rich of corrective media within the concrete and under a harmful external working environment. In addition, the present invention provides a stable output current and so as to omit the conventional control and investigation system and simplify the configuration of the present invention. At the same time, the CFRP, the concrete, and the steel reinforcing elements are integrally mounted to be a whole unit so as to omit the installation process of the cathode protection body and improve the efficiency of the construction.

Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
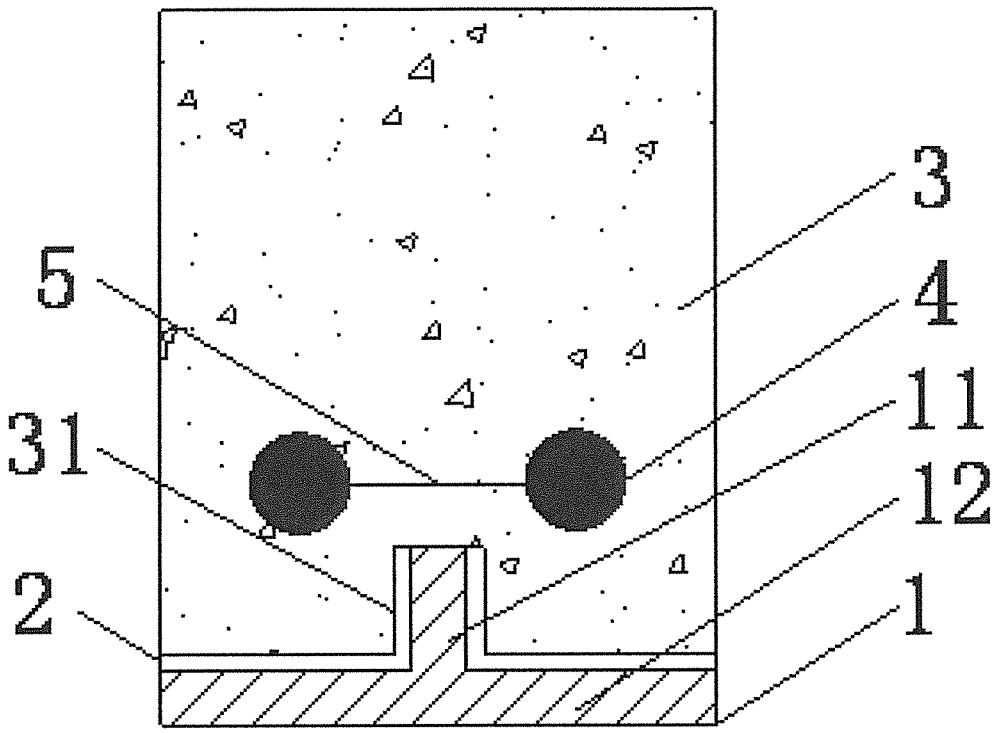
FIG. 1 is structural perspective view of a cathode protection apparatus of embedded CFRP anode for a reinforced concrete structure according to a preferred embodiment of the present invention.

Referring to FIG. 1 of the drawings, a cathode protection apparatus of embedded CFRP anode for reinforced concrete structure according to a preferred embodiment of the present invention is illustrated, wherein the cathode protection apparatus of embedded CFRP anode for reinforced concrete structure comprises a plurality of steels reinforcing elements 4 embedded in a concrete body 3, (for example, two steel reinforcing elements are shown steel reinforcing element in FIG. 1), wherein each of the steel reinforcing elements is electrically connected together by conductive wires. The cathode protection apparatus of embedded CFRP anode for reinforced concrete structure further comprises at least a CFRP member 1, wherein the concrete 3 is a reinforced concrete body 3 having a preformed groove 31 indentedly provided therein and defining adjacent side surfaces thereon adjacent to the preformed groove 31. The shape and size of the preformed groove 31 and the substantial number of such preformed groove are determined according to the requirement of the cathode protection.

The CFRP member 1 comprises a reinforcing column 11 and a reinforcing plate 12 integrally connected with the reinforcing column 11, wherein the reinforcing column 11 is shaped and sized to match with and insert in the preformed groove and the reinforcing plate 12 is affixed to the adjacent side surfaces of the protection area of reinforced concrete body 3 respectively via electrically conductive adhesive material 2. Ire other words, the reinforcing column 11 and the reinforcing plate 12 of the CFRP member 1 is connected with preformed groove 31 and the adjacent side surfaces of the reinforcing concrete body by means of the adhesive material 2 so as to reduce a distance between the CFRP member and the steel reinforcing elements in the reinforcing concrete body 1, so that the resistance therebetween is decreased accordingly and thus rendering the protective current thereof being more uniformly and evenly.

In substantial application, the adhesive material is required to meet the requirements of providing electrical conductivity and enabling the CFRP rigidly affixed on the surface of the concrete. For example, the adhesive material 2 can be cement grout, such as inorganic cementations materials, or conductive particles, such as epoxy glue with graphite powder that can achieve the above requirements. Preferably, according to the present invention, the cement grout is used as the adhesive material 2 that can adhere to the surfaces of the CFRP member 1. It not only has a really high strength and it can also connect the CFRP member with the concrete that can substantially increase the stability, as a whole, for the application of the cathode protection method of embedded CFRP anode for the reinforced concrete structure, wherein the preferred thickness of the adhesive material 2 is about 3 mm.

The CFRP member 1 is connected to a positive electrode of an external direct current (DC) power supply (not shown in Figures), and the steel reinforcing element 4 is connected to a negative electrode of the external power supply, wherein the steel reinforcing elements 4 is connected with the CFRP member 1 via the adhesive material 2 and the concrete 3 to form a close electrical conductive circuit.

The carbon fiber reinforced polymer (CFRP) material not only has excellent dynamic property. Its essential element, carbon fiber, has good electrical conductivity and its electrode potential is closed to the electrochemical property of the noble metal. Therefore, in the above described apparatus of the present invention, the using of the CFRP member 1 as the cathode of the electric current to assist the anode can adequately utilize its dynamic performance and electrochemical property. It provides cathode protection and technical performance while considering the structural reinforcement. In addition, the cost of using CFRP material is cheaper than cathode made of mixture of metal and titanium oxide so that the cost of the present invention is reduced. Also, it can be various sectional forms, rendering easy utilization in application.

Preferably, when the adhesive material is cement grout, the surface contact between the adhesive material and the CFRP is ensured and its thickness adhesive material is suggested to be about 3 mm.

In the above described apparatus of the present invention, the number of the steel reinforcing elements may be plenty according to different areas needed to be protected. The steel reinforcing elements are required to be connected with each other by electrical conductive wires, wherein their electric conductivity must be tested to ensure the steels reinforcing elements within the concrete structure area can be well protected.

It is worth mentioning that the reinforced concrete structure of the present invention is not limited to rectangular structure as shown in FIG. 1. It can be other structures and shapes, such as cylindrical concrete, etc.

Figure 2:
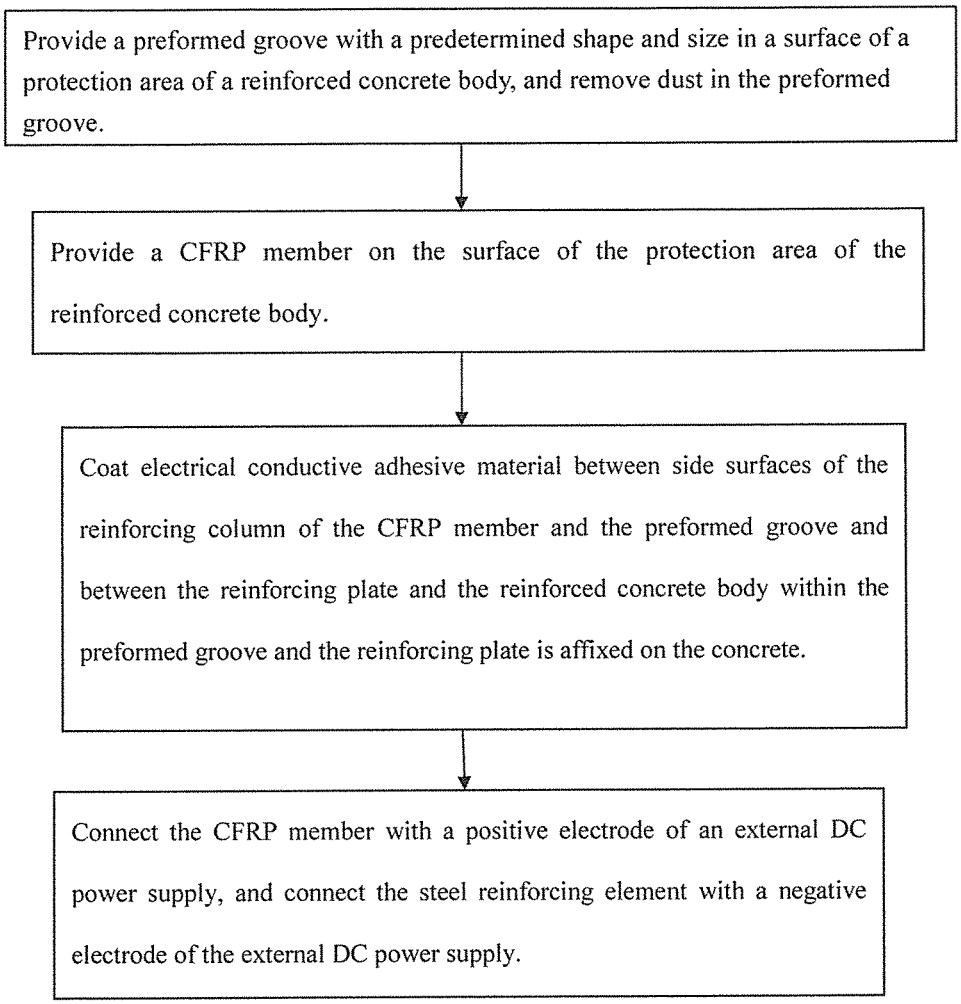
FIG. 2 is a block diagram of a cathode protection method of embedded CFRP anode for the reinforced concrete structure according to the above preferred embodiment of the present invention.

According to the embedded CFRP anode for a reinforced concrete structure and apparatus described above, a cathode protection method for embedded CFRP anode for a reinforced concrete structure is provided, as shown in FIG. 2, wherein the method comprises the steps of:

S1. Provide a preformed groove 31 with a predetermined shape and size in a protection area of a reinforced concrete body 3, and remove dust in the preformed groove.

Before the step S1, in order to enable the concrete within the protection area can become continuous electrolyte, it is required to remove any loose concrete within the protection area of the reinforced concrete body 3, to explode the firm and solid portion, to polish and smoothen to flat and clean, to add adhesive material to any uneven and non-flat area of the concrete, and to squeeze out air within any area mixed with adhesive material, and to remove the excessive adhesive material.

S2. Provide at least a CFRP member on the respective surface of the protection area of the reinforced concrete body, wherein the CFRP member includes at least a reinforcing column 11 shaped and sized with respect to the preformed groove 31 and at least a reinforcing plate 12 integrally connected with the reinforcing column 1 and affixed on the portion adjacent to the preformed groove 31 of the surface of the protection area of the reinforced concrete body 3.

That is the CFRP member 1 is connect to the reinforced concrete body 3, wherein the CFRP member 1 comprises the reinforcing column 11 and a reinforcing plate 12 integrally connected to the reinforcing column 11, wherein the reinforcing column 11 is embedded and inserted in the indented preformed groove 31 while the reinforcing plate 12 is a CFRP plate affixed to the adjacent side surfaces in the protection area of the reinforced concrete body.

S3. Coat an adhesive material 2 with electrical conductive ability on side surfaces of the reinforcing column 11 and the preformed groove 31 of the reinforced concrete body 3 to be connected with each other and between the reinforcing plate 12 and the reinforcing concrete body 3. Embed the reinforcing column 11 in the preformed groove 31 of the reinforced concrete body 3 and connect the reinforcing plate 12 with the reinforced concrete body 3.

That is to coat the adhesive material 2 between the CFRP member 1 and the reinforced concrete body 3. In other words, the adhesive material 2 is applied between the reinforcing column 11 and the preformed groove 31 and between the reinforcing plate 12 and the reinforced concrete body 1 so as to adhere the reinforcing column 11 in the preformed groove 31 and the reinforcing plate 12 with the reinforcing concrete body 3 in order to connect CFRP member 1 with reinforced concrete body 3.

S4. Connect the CFRP member 1 with a positive electrode of an external DC power supply, and connect the steel reinforcing elements with a negative electrode of the external DC power supply, so that the steel reinforcing elements 4 and the adhesive material 2 are electrically connected via the concrete of the reinforced concrete body 3 to form a closed electric conductive circuit.

In the step S4, if the number of the of the steel reinforcing element within the protection area is more than one, all the steel reinforcing elements 5 within the protection area must be electrically connected with each other, wherein the electrical conductivity between the steel reinforcing elements 4 must be examined and ensured, as well as the electrical conductivity between the reinforced concrete body 3 and the CFRP member 1 must also be examined and ensured, so as to ensure the entire circuit can transmit cathode protective current.

The adhesive material 2 is required to have electrical conductivity and its strength must be strong enough. Preferably, the adhesive material 2 used in the present method is cement grout. In a preferred embodiment, the cement grout is needed to fill the cracks in the concrete to ensure the concrete becomes a continuous electrolyte.

The present invention provides a cathode protection method of embedded CFRP anode for reinforced concrete structure and apparatus thereof, wherein the apparatus utilizes the more cost effective CFRP material as auxiliary anode to substitute the conventional mixture of metal and titanium oxide. In addition, the present invention utilizes adhesive material with electrical conductivity and larger strength to connect the steel reinforcing elements and the CFRP material, so as to achieve ideal protection while reducing the cost and enhancing the stability of the protection apparatus. The using of the column shaped section for the CFRP member substantially reduces the distance between the CFRP member and the steel reinforcing elements as well as the resistance therebetween, so as to provide a more even distribution of the protective current in the concrete structure and achieve a better protection effect.

Figure 3:
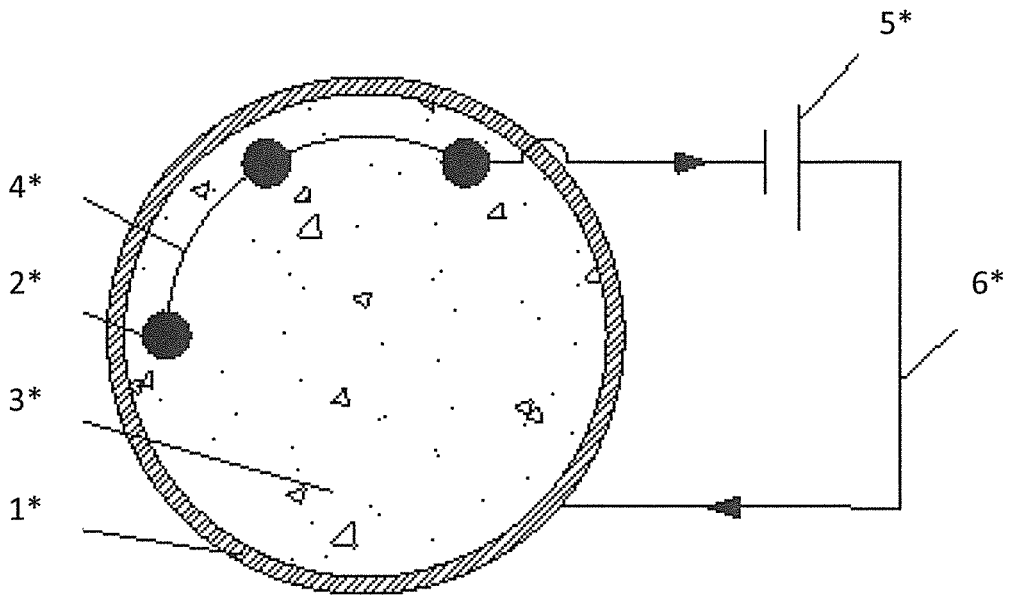
FIG. 3 is a structural perspective view of a composite structure for reinforced concrete structure with automatic cathode protection CFRP structure according to a second preferred embodiment of the present invention.

Referring to FIG. 3 of the drawings, a composite structure for reinforced concrete structure with automatic cathode protection CFRP structure according to a second preferred embodiment of the present invention is illustrated, wherein the composite structure comprises two structural bodies, which are a reinforced concrete body and cathode protection body.

The reinforced concrete body comprises a concrete 3*, a plurality of steel reinforcing elements 2*, a CFRP pipe 1*, wherein the steel reinforcing elements 2* are embedded within the concrete 3*, wherein the CFRP pipe 1* is arranged on a surface of the reinforced concrete body, and is electrically connected with the steel reinforcing element 2* via the concrete 3*. And, an external power supply 5* is connected to at least one steel reinforcing elements 2* of the reinforced concrete body and the CFRP pipe 1* for impressing current to the steel reinforcing element 2*. In the present invention, the reinforced concrete body is integrally mounted with the CFRP pipe 1*.

The CFRP pipe 1* is a composite material mixing with different fibers or matrix materials, such as carbon fiber and glass fiber (a fiber-reinforced composite material).

The present invention utilizes the advantages of the excellent dynamic, and electrochemical properties of the CFRP, the CFRP is not only used to be a reinforcing material, but also can be used to an auxiliary anode. Therefore, the structural reinforcement system and the cathode protection system are integrated to be one structural system, According to the above described composite structure, even if the steel reinforcing elements 2* are embedded into a concrete with rich of corrective media, such as sea sand type concrete, all steel reinforcing elements 2* therein are well protected. The steel reinforcing elements 2*—the concrete 3*—the CFRP pipe 1* (connected by a conductive wire 6*) form a complete conductive circuit to smoothly transmit the cathode protection current. The present invention utilizes an external power supply 5* with a constant output current or voltage to impress weak current to the steel reinforcing elements 2* to achieve the cathode protection, such that the cathode current is applied to the steel reinforcing elements 2* for forcing the potential of the steel reinforcing elements 2* in the corrosion-free area so as to reach the protection purpose for the steel reinforcing element 2*. And, the external power supply 5* is a DC power supply providing a constant output current and voltage.

According to the above second preferred embodiment of the present invention, the reinforced concrete body can be a circular concrete column or a rectangular structure, and FIG. 3 shows the cylindrical reinforced concrete body structure. Referring to FIG. 3 of the drawings, a plurality of steel reinforcing elements 2* are arranged around a peripheral of the concrete 3*, and each of the adjacent steel reinforcing elements 2* is electrically connected, so the electrically-connected steel reinforcing elements 2*, the concrete 3*, and the CFRP pipe 1* are integrally mounted with each other so as to omit the installation process for the cathode protection body. In other words, the external powers supply 5* of the cathode protection body is directly connected to the reinforced concrete body. For example, the external power supply 5* has a negative electrode connecting to any of the steel reinforcing elements 2*, and a positive electrode connecting to the CFRP pipe 1*, so as to from the cathode protection body.

The CFRP pipe 1* is a reinforcing material and an auxiliary anode in the present invention, and the CFRP member must have a reliable dynamic property, electrochemical properties and durability properties under a long term usage, environmental factors and the interaction of the protection current interaction, so as to achieve structural reinforcement and cathode protection.

In the above described apparatus of the present invention, the number of the steel reinforcing elements 2* must be at least one. When the number of the steel reinforcing elements 2* is larger than one, each of the steel reinforcing elements 2* is required to be connected with each other by an electrical conductive wire 4*, wherein their electric conductivity must be tested. The number of the steel reinforcing elements 2* is not limited, which can be three, four, five, or other number thereof.

The carbon fiber reinforced polymer (CFRP) has the advantages of light in weight, high in strength, high in modulus, and having good corrosion resistance, so CFRP is a well-known structural reinforcing material. Actually, including the well-known dynamic properties of CFRP, its essential element, carbon fibers, has good electrochemical properties, which has good electrical conductivity and the electrode potential is closed to the electrochemical property of the noble metal. Therefore, the electrochemical properties of the CFRP can be applied to the auxiliary anode of the impressed current cathode protection system for the reinforced concrete structures.

Furthermore, according to the dynamic properties and electrochemical properties of CFRP, a composite structure having cathode protection and steel reinforcing element protection function is provided. That is to say, the CFRP not only has advantages in the composite structure, but also can be an auxiliary anode in the impressed current cathode protection system. The present invention can achieve a purpose of achieving a structural reinforcement and cathode protection function in the same structure, and the CFRP is an auxiliary anode to eliminate to install a control system and an investigation system.

A processing method for reinforced concrete structure with automatic cathode protection CFRP structure comprises steps of:

A. integrally mounting a reinforced concrete body with a CFRP member 1*:

B. mounting the CFRP member 1* on a surface of a reinforcing region of the reinforced concrete body;

C. embedding at least one steel reinforcing elements 2* around an inner peripheral of the reinforced concrete body; and D. connecting an external power supply 5* to the CFRP member 1* for impressing current to the steel reinforcing elements 2*.

Moreover, the CFRP member 1* is a composite material, which mixes with different fibers or matrix materials.

The present invention provides a composite structure and method for reinforced concrete structure with cathode protection CFRP structure, wherein the present invention provides a cathode protection, and the steel reinforcing elements 2* within the concrete 3* are impressed by a weak current via the CFRP materials so as to achieve the protection purposes, so the corrosion of the steel reinforcing elements 2* within the sand concrete has been actively prevented. And, the CFRP has dual-functions of the structural reinforcement and the cathode protection. While present invention is applied to the reinforced concrete structure, the steel reinforcing elements 2* can be well-protected under rich of corrective media within the concrete and under harmful external working environment. In addition, the present invention provides a stable output current so as to omit the conventional control and investigation system and simplify the configuration of the present invention. At the same time, the CFRP member 1*, the concrete 3*, and the steel reinforcing elements 2* are integrally mounted to be a whole unit so as to omit the installation process of the cathode protection body and improve the efficiency of the construction.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cathode protection method for a reinforced concrete structure, comprising the steps of:

(a) embedding a plurality of steel reinforcing elements in a surface of a protection area of a reinforced concrete body, and electrically connecting said steel reinforcing elements with each other in said protection area;

(b) treating said surface of said protection area of said reinforced concrete body by the steps of polishing and smoothing said surface of said protection area of said reinforced concrete body, applying an adhesive on any uneven and non-flat area of said reinforced concrete body, removing air mixed in said adhesive in said protection area, and removing excessive adhesive in said protection area;

(c) forming a preformed groove with a predetermined shape and size on said surface of said protection area of said reinforced concrete body, and removing dust in said preformed groove;

(d) forming a CFRP member which comprises a reinforcing column and a reinforcing plate integrally connected with said reinforcing column, wherein said reinforcing column is sized and shaped matching with said preformed groove;

(e) applying an electrically conductive adhesive material on said CFRP member and placing said CFRP member on said protection area of said reinforced concrete body at a position that said reinforcing column is inserted into said preformed groove and said reinforcing plate covers said surface of said protection area of said reinforced concrete body, wherein via said electrically conductive adhesive material, said reinforcing column is adhered in said preformed groove and said reinforcing plate is adhered on said surface of said protection area of said reinforced concrete body so as to embed said reinforcing column in said preformed groove of said reinforced concrete body and to cover said preformed groove by said reinforcing plate; and (f) electrically connecting an external DC power supply with said CFRP member and said steel reinforcing elements in said reinforced concrete body by electrically connecting said CFRP member with a positive electrode of said external DC power supply and electrically connecting said steel reinforcing elements with a negative electrode of said external DC power supply, wherein said steel reinforcing elements and said electrically conductive adhesive material are electrically connected via said reinforced concrete body, said CFRP member and said external DC power supply to form a closed electrical conductive circuit.

2. The method, as recited in claim 1, wherein the step (e) further comprises the steps of:

(e.1) coating said electrically conductive adhesive material on side surfaces of said reinforcing column and said preformed groove to adhere said reinforcing column in said preformed groove; and (e.2) coating said electrically conductive adhesive material between said reinforcing plate and said surface of said protection area of said reinforced concrete body to adhere said reinforcing plate on said surface of said protection area of said reinforced concrete body.

3. The method, as recited in claim 1, wherein said electrically conductive adhesive material is cement grout not only adhering said CFRP member on said surface of said protection area of said reinforced concrete body but also filling cracks in said protection area of said reinforced concrete body.

4. The method, as recited in claim 2, wherein said electrically conductive adhesive material is cement grout not only adhering said CFRP member on said surface of said protection area of said reinforced concrete body but also filling cracks in said protection area of said reinforced concrete body.

5. The method, as recited in claim 1, wherein said electrically conductive adhesive material is epoxy glue with graphite powder.

6. The method, as recited in claim 2, wherein said electrically conductive adhesive material is epoxy glue with graphite powder.

7. A cathode protection apparatus for a reinforced concrete structure, comprising:

a reinforced concrete body defining a protection area and having a preformed groove indented on a surface of said protection area;

a plurality of steel reinforcing elements embedded in said protection area of said reinforced concrete body, wherein said steel reinforcing elements are electrically connected with each other;

at least a CFRP member comprising a reinforcing column and a reinforcing plate integrally extended with said reinforcing column, wherein said reinforcing column which is shaped and sized matching with said preformed groove, wherein said CFRP member is placed on said protection area of said reinforced concrete body at a position that said reinforcing column is inserted into said preformed groove and said reinforcing plate covers on said surface of said protection area of said reinforced concrete body;

an electrically conductive adhesive material applied on said CFRP member to adhere said reinforcing column in said preformed groove and to adhere said reinforcing plate on said surface of said protection area of said reinforced concrete body so as to embed said reinforcing column in said preformed groove of said reinforced concrete body and to cover said preformed groove by said reinforcing plate; and an external DC power supply electrically connecting with said CFRP member and said steel reinforcing elements in said reinforced concrete body, wherein said CFRP member is electrically connected with a positive electrode of said external DC power supply and said steel reinforcing elements are electrically connected with a negative electrode of said external DC power supply, wherein said steel reinforcing elements and said electrically conductive adhesive material are electrically connected via said reinforced concrete body, said CFRP member and said external DC power supply to form a closed electrical conductive circuit.

8. The cathode protection apparatus, as recited in claim 7, wherein said electrically conductive adhesive material is coated on side surfaces of said reinforcing column and said preformed groove to adhere said reinforcing column in said preformed groove, and is coated between said reinforcing plate and said surface of said protection area of said reinforced concrete body to adhere said reinforcing plate on said surface of said protection area of said reinforced concrete body.

9. The cathode protection apparatus, as recited in claim 7, wherein said electrically conductive adhesive material is cement grout not only adhering said CFRP member on said surface of said protection area of said reinforced concrete body but also filling cracks in said protection area of said reinforced concrete body.

10. The cathode protection apparatus, as recited in claim 8, wherein said electrically conductive adhesive material is cement grout not only adhering said CFRP member on said surface of said protection area of said reinforced concrete body but also filling cracks in said protection area of said reinforced concrete body.

11. The cathode protection apparatus, as recited in claim 7, wherein said electrically conductive adhesive material is epoxy glue with graphite powder.

12. The cathode protection apparatus, as recited in claim 8, wherein said electrically conductive adhesive material is epoxy glue with graphite powder.

* * * * *